US007982121B2

(12) United States Patent
Randle et al.

(10) Patent No.: US 7,982,121 B2
(45) Date of Patent: Jul. 19, 2011

(54) DRUM LOOPS METHOD AND APPARATUS FOR MUSICAL COMPOSITION AND RECORDING

(76) Inventors: Quint B. Randle, Orem, UT (US); Guy L. Randle, Provo, UT (US); Todd Sorensen, Pleasant Grove, UT (US)

( * ) Notice: Subject to any disclaimer, the term of this patent is extended or adjusted under 35 U.S.C. 154(b) by 1137 days.

(21) Appl. No.: 11/185,551

(22) Filed: Jul. 20, 2005

(65) Prior Publication Data

US 2006/0016322 A1 Jan. 26, 2006

Related U.S. Application Data

(60) Provisional application No. 60/590,079, filed on Jul. 21, 2004.

(51) Int. Cl.
*G10H 1/40* (2006.01)
*G10H 7/00* (2006.01)

(52) U.S. Cl. ..... 84/611

(58) Field of Classification Search ..... 84/609–612
See application file for complete search history.

(56) References Cited

U.S. PATENT DOCUMENTS

2004/0159216 A1* 8/2004 Davis et al. ..... 84/609
2004/0193642 A1* 9/2004 Allen et al. ..... 707/104.1
2006/0075887 A1* 4/2006 Shotwell et al. ..... 84/645
2006/0080335 A1* 4/2006 Freeborg et al. ..... 707/100
2006/0180007 A1* 8/2006 McClinsey ..... 84/645
2007/0119290 A1* 5/2007 Nomitch ..... 84/603

OTHER PUBLICATIONS

"ACID PRO 4.0 Manual," Sonic Foundry, 2003.*
"Drums on Demand vol. 5 and Acousitc Percussion," Sep. 3, 2005, Fred Grittner, CakewalkNet.com.*
"How to make better sounding Drum Tracks," Music-and-Technology.com, 2000, pp. 1-5.*
A drum loop product with a copyright dated from 2001-2002 (15 pages).
http://emusician.com/libraries/emusic_groove_shoppin/ (6 pages).
Wikipedia, "GarageBand", Feb. 20, 2006, pp. 1-2.
Pogue, David, "iLife '04—The Missing Manual", Pogue Press 2003, pp. 33-35.

* cited by examiner

*Primary Examiner* — Jeffrey Donels
(74) *Attorney, Agent, or Firm* — Holland & Hart LLP

(57) ABSTRACT

One of many possible embodiments includes a method of recording and organizing drum sequences for use in composing music. The method includes recording a drum performance, separating the recorded drum performance into drum loops, organizing the drum loops into a song set, and providing a unique name for each drum loop. The unique name is descriptive of a possible position or function of each drum loop in the song set. In some embodiments, the song set and the drum loops are named and organized hierarchically to guide composers in conveniently selecting desired drum loops. In some embodiments, one or more song sets is provided on a processor-readable medium.

33 Claims, 9 Drawing Sheets

250

Name

- 057 BPM (Brushes Ballad 12_8) — 252
- 060 BPM (Odd Time Ballad 12_8)
- 064 BPM (Slow 16th's)
- 066 BPM (Power Ballad)
- 070 BPM (Slow N Sloshy)
- 072 BPM (Funky Off Beat)
- 078 BPM (Jazzy Ghosts Notes)
- 078 BPM (Sassy Shuffle)
- 079 BPM (Sloshy Rock Ballad)
- 079 BPM (Snappy Rocker)
- 079 BPM (Stirring Brushes 3_4)
- 081 BPM (16th Kick)
- 089 BPM (Jazzy Brushes)
- 089.83 BPM (Smashin)
- 097 BPM (Odd Time Shuffle 3_4) — 254
- 098 BPM (Country Two Step)
- 106 BPM (Shuffle)
- 107.15 BPM (Straight Rock)
- 109 BPM (Eighth Rocker)
- 113 BPM (Brush Shuffle)
- 113 BPM (Pop Boogaloo)
- 126 BPM (Big Kick)
- 126 BPM (Straight Pop Rock) — 256
- 128 BPM (Wipers)
- 132 BPM (8th Note Chugger)
- 134.20 BPM (Country Brushes)
- 141 BPM (Let Loose)
- 142 BPM (Brush Shuffle)

FIGURE 4

300

Name

302

!Chorus.Rim.WAV
!Chorus.WAV
!ChorusB.WAV

304

!Verse.Rim.WAV
!VerseB.WAV

306

Chorus.Crash.WAV
Chorus.Fill1.WAV
Chorus.Fill2.WAV
Chorus.Fill3.WAV
Chorus.Fill4.WAV
Chorus.Rim.Crash.WAV
Chorus.Rim.Fill1.WAV
ChorusB.Crash.WAV
ChorusB.Fill1.WAV

308

Ending.WAV

310

Fill1.WAV
Fill2.WAV

312

Verse.Rim.Alt.WAV
Verse.Rim.Crash.WAV
Verse.Rim.Fill1.WAV
VerseB.Crash.WAV
VerseB.Fill1.WAV

FIGURE 5

350

352

Loop Layers

- LL.H1.wav
- LL.H2.wav
- LL.H3.wav
- LL.K1.wav
- LL.R1.wav
- LL.R2.wav
- LL.R3.wav
- LL.Rim.wav
- LL.S2.wav

356

358

Single Hits

- H1.wav
- H2.wav
- HO.wav
- HT1.wav
- HT2.wav
- HT3.wav
- K1.wav
- K2.wav
- K3.wav
- LT1.wav
- LT2.wav
- LT3.wav
- MT1.wav
- MT2.wav
- MT3.wav
- Rim.wav
- S1.wav
- S2.wav
- S3.wav

354

360

FIGURE 6

DRUM LOOPS METHOD AND APPARATUS FOR MUSICAL COMPOSITION AND RECORDING

RELATED APPLICATION

This application claims priority under 35 U.S.C. §119(e) to U.S. Provisional Patent Application No. 60/590,079, entitled DRUM LOOPS METHODS AND APPARATUS FOR MUSICAL COMPOSITION AND RECORDING, filed Jul. 21, 2004, the contents of which are incorporated by reference in their entirety.

FIELD OF THE INVENTION

The present invention relates generally to musical composition and recording. In particular, the present invention relates to drum loops methods and apparatus for use in musical composition and recording.

BACKGROUND INFORMATION

In composing and recording music, various types and sequences of rhythms and beats provide a beat for the music. Often, drums or other percussion instruments are used for this purpose. Electronic instruments having synthesizers have been used to generate drum beats. However, it is difficult to synthesize all of the types of beats and rhythmic sequences that are needed for a wide variety of musical compositions. Furthermore, there are frequently problems with achieving realistic sounds using synthesizers.

Some efforts have been made to record and play back actual drum beats and drum beat sequences for various uses. In U.S. Pat. No. 6,075,197 (Chan), electrical sensors are attached to a plurality of drum plates for playing back recorded percussion sounds in response to and synchronized with a user beating on the drum plates. In U.S. Pat. No. 4,305,319 (Linn), a single drum beat is recorded and then played back by a plurality of modular drum generators to provide desired percussion rhythms.

Other products in the marketplace provide various drum sequences without much organization or continuity. Even with a stored data bank of recorded drum beats and other percussion sequences, it is often difficult to find and identify appropriate combinations of drum and other percussion sequences to be used in or for a musical composition. In addition, numerous embellishments and variations in drum sequences are desirable to achieve a realistic performance in a recorded song or production. Consequently, drum loops, as stored in existing tools, are difficult to piece together in a way that provides a smooth and continuous flow for song composition and music production. Furthermore, a finished, polished drum sound is difficult to achieve by patching together various drum beat segments that have been separately recorded.

Accordingly, there is a need for a wide variety of live drum performance sequences and loops that are easily accessible and that are organized and named so composers can easily select desired rhythms and sequences for each musical composition. Moreover, there is a need for a wide variety of embellishments and variations on selected drum loops to achieve a realistic drum performance accompanying various musical compositions.

SUMMARY OF THE INVENTION

One of many possible embodiments includes a method of recording and organizing recorded drum sequences for use in composing music. The method includes recording a drum performance, separating the recorded drum performance into drum loops, organizing the drum loops into a song set, and providing a unique name for each drum loop. The unique name is descriptive of a possible position or function of each drum loop in the song set. In some embodiments, the song set and the drum loops are named and organized hierarchically to guide composers in conveniently selecting desired drum loops. In some embodiments, one or more song sets is provided on a processor-readable medium.

BRIEF DESCRIPTION OF THE DRAWINGS

FIG. 4 is an exemplary schematic directory of digital song sets according to an embodiment of the present invention;

FIG. 5 is an exemplary schematic list of master and secondary drum loops according to one of the digital song sets of the embodiment shown in FIG. 4;

FIG. 6 is an exemplary schematic list of loop layers used in conjunction with the drum loops shown in the embodiment of FIG. 5;

DETAILED DESCRIPTION OF EXEMPLARY EMBODIMENTS

Figure 1:
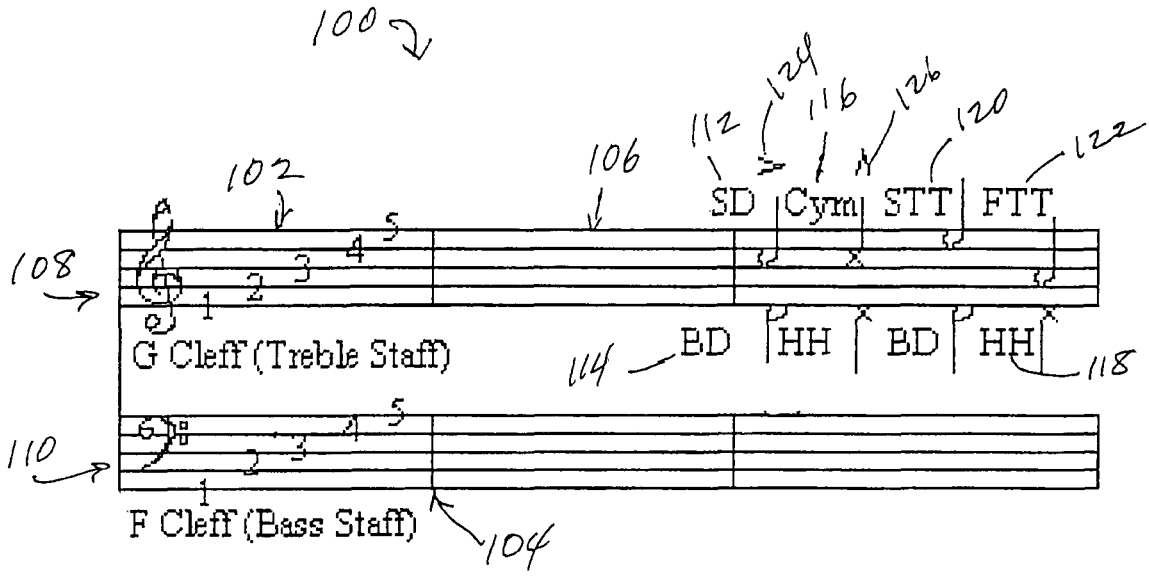
FIG. 1 is a schematic drum chart layout showing some of the characteristics of a drum chart.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention utilizes one or more entire recorded performances to develop a variety of drum loops for use in organized song sets, for the purpose of assisting composers in the development of original recorded compositions. As used herein, the term "drum" refers broadly to any percussion instrument, including snares, bass drums, cymbals and the like. The terms "drum loop" or "loop" refer to a sequence of recorded drum beats, usually, but not always, one to two measures in length, that can be connected together or repeated, as desired. The term "master loop" means a drum loop that forms a main part of a song set, such as a chorus, verse or bridge. The term "matching loop" means a drum loop that forms a variation of a master loop, such as a fill or alteration, for example. The term "loop layer" refers to a rhythmic recording of a single percussion instrument that can be combined with other loop layers to form a custom drum loop. A "single hit" is a recording of a single beat or strike of a particular instrument, without any particular rhythm, that can be combined with other loop layers and other single hits to form a custom drum loop, fill or pattern.

As used herein, the terms "generic performance," "recorded performance" and "pre-recorded performance" refer to a sequence of recorded drum beats and rhythms providing a generic or stylistic accompaniment of an entire song or musical composition, or common patterns that are inspired by a musical composition, style or genre. The term "song set" refers to a recorded assembly of drum loops and loop layers all related to a recorded performance. The terms "composed performance" or "original composition" refers to a composed percussion accompaniment to a musical composition using drum loops and loop layers. The intended meanings for these and other terms will become even clearer from their use throughout the specification and claims.

It should be understood that a musical composer may use a variety of PC-based software, platforms and audio work stations to assemble drum recordings for accompanying created musical compositions. One object of the present invention is to assist a composer in assembling drum recordings in an easy and organized manner, in order to more readily develop a drum accompaniment having realistic and flowing characteristics. In particular, a musical composer may easily and conveniently utilize the song sets and the drum loops contained therein to aid in the creation of musical compositions, as described below.

In the present invention, rather than recording different drum loops separately, a generic or stylistic drum performance is recorded in its entirety, with an actual drummer (e.g., a human professional drummer) providing the entire performance in one relatively uninterrupted recording. Upon completion, the recorded performance may be dissected into various drum loops, and each loop is labeled to describe its function and/or position in the overall recorded performance. The drum loops are then provided to a composer in a song set so that the composer can assemble some of the drum loops to form a new performance and/or composition.

From the recorded performance, several master loops may be identified that form a primary groove or rhythm of a composed performance, the recorded drum performance, or a song set. In other words, the master loops are representative of the main part, or core part, of the recorded drum performance. Typically, the master loops include one or more verses, choruses, and bridge loops of the song set. Although not the case in all song sets, some embodiments of song sets may include approximately three to six master loops. In addition to master loops, various secondary or matching loops may be separated out from the record performance. Matching loops may alternately include embellishments, fills, introductions and endings, to name a few. Each matching loop may be labeled to identify it with a corresponding master loop and/or to describe the particular sound or function being provided. There may be 15 to 50 different matching loops in some song set embodiments.

In accordance with the invention, a composer may utilize the master and matching loops to create musical compositions. In particular, the composer may select any or all of the master loops and then insert as many of the matching loops as desired in a limitless variety, in order to provide suitable percussion accompaniment for a musical composition. For example, the matching loops may be superimposed over at least part of one or more master loops. The finished new drum song comprises drum loops link together seamlessly in the original composition with a flowing continuity that derives from the unity of the original recorded drum performance or song set.

In addition, loop layers and single hits may be recorded and provided for producing custom drum loops. As mentioned above, a loop layer is a rhythmic loop recording of usually, but not always, one to two measures of a single percussion instrument. A single hit is a recording of a single sound or strike by a single percussion instrument. A composer may select several loop layers and/or single hits and superimpose them on each other in the same measure or measures of a composed performance, to effectively design a custom loop. Each loop layer and single hit may be recorded separately, to avoid problems with bleeding over of other simultaneous percussion sounds.

Another aspect of the present invention includes naming each drum song set and drum loops, loop layers and single hits to easily identify their function and possible position in a new composition. In addition the drum loops, loop layers and single hits may be arranged in the song sets in a hierarchical fashion. This arrangement enables a composer to quickly access segments of a song set to determine whether a song set, drum loop, loop layer or single hit is appropriate for an original composition. In some embodiments, for example, contents of song sets are arranged with the master loops first, matching loops next and finally the loop layers and single hits following the matching loops. This hierarchical arrangement enables a composer to systematically piece together an original composition uses contents selected from a song set.

In some embodiments, multiple tracks of the drum loops are provided to enable a composer to do custom mixing. During recording of a song set, multiple tracks may be recorded. When the song set is separated into distinctive loops, each of the multiple tracks associated with each of the loops may be provided to a composer. The composer may then vary the volume, brilliance, resonance, reverberation and other aspects of each of the loops, in order to further customize the final product. Each track may correspond with a particular type of percussion instrument, as described below.

FIG. 1 is provided by way of general background information. As shown in FIG. 1, a basic drum music staff 100 is shown with different types of drum actions being listed thereon. As shown, the staff 100 may comprise two sets of five horizontal lines 102. Vertical lines 104 break the staff into separate bars, also called measures 106. Clef signs designate the pitch of each line on the staff. They are not needed for drum set music, but are used for tympani, vibes, marimba, and other pitched percussion instruments. The treble clef 108, also called the "G" clef, designates higher pitched percussion instruments, and the bass or "F" clef 110 relates to lower pitched percussion instruments.

The third bar in FIG. 1 illustrates normal staff line designations for various parts of a drum set. These parts may vary, depending on who writes the drum chart. The key is as follows: "SD" is a snare drum 112, "BD" is a bass drum 114, "Cym" is a cymbal 116, "HH" is a hi-hat 118, "STT" is a small tom tom 120, and "FTT" is a floor tom tom 122. Finally, the sideways "V" 124 and the upside down "V" 126 both stand for accents, meaning that the note should be played louder than the other notes.

Figure 2:
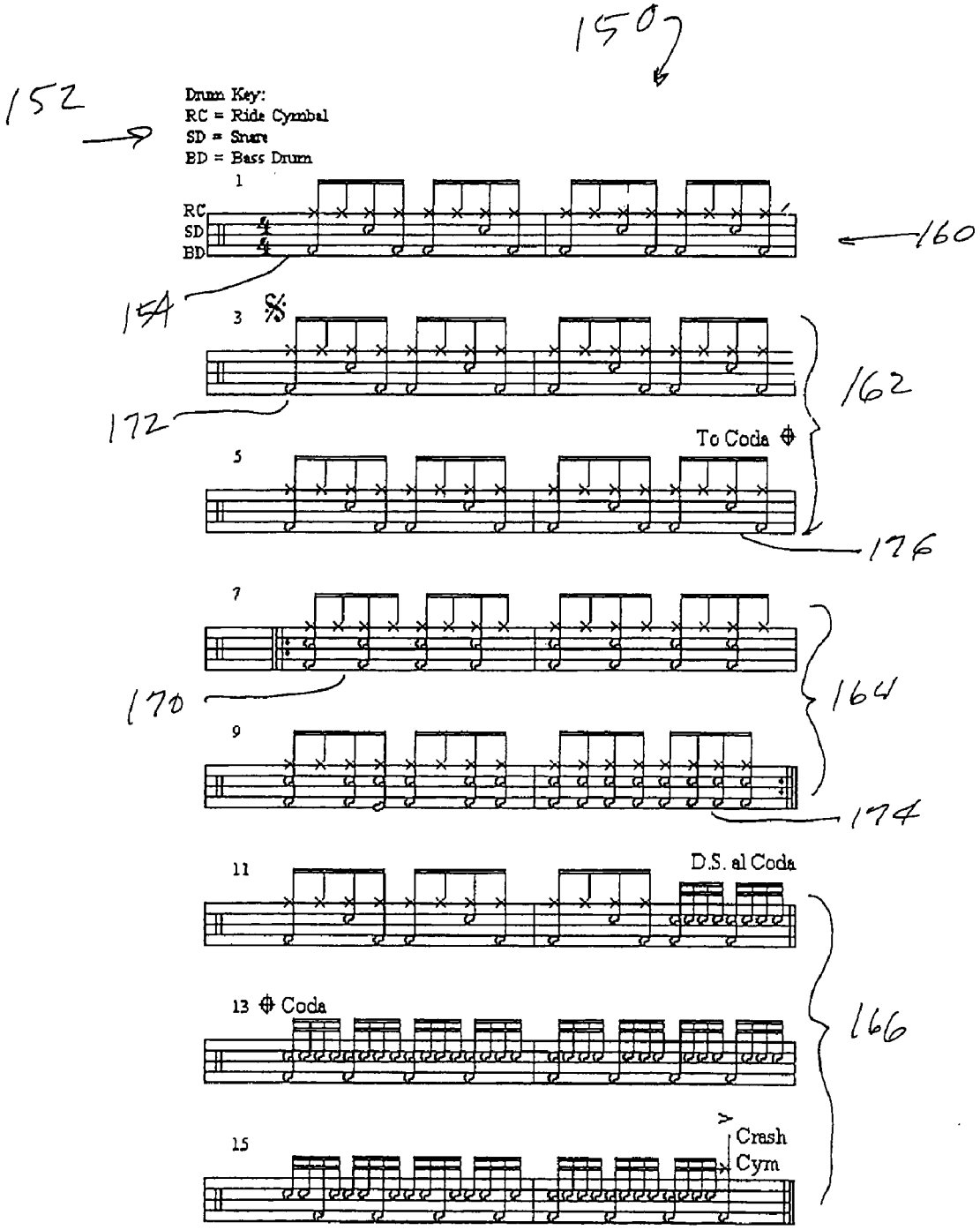
FIG. 2 is a schematic drum chart of a recorded song set that may be used to form drum loops in connection with an embodiment of the present invention.

Looking at FIG. 2, an example of a drum chart 150 is shown for a selected generic performance or exercise to be recorded and used to create a song set in accordance with the present invention. The drum chart 150 includes a key 152 indicating the percussion instruments and the position of the notes of each instrument on the music staff. The drum chart 150 includes a plurality of measures 154, and the drum actions to be taken in each measure. The recorded drum song may be an exercise or a song from a composition or a particular style or genre, having a determined number of beat per minute (BPM). For example, a slow drum song might be a brushes ballad at 57 BPM, and a more upbeat drum song might be a Straight Pop Rock at 107 BPM.

To assist in understanding the exemplary drum loops discussed below, the drum chart 150 may be thought of as being divided into different sections including a beginning 160, one or more verses 162, a chorus 164 and an end 166. Bridges, fills and other additional features may also be a part of the drum chart 150. Each section may be comprised of segments, most of which are one to two measures in length. The segments are often repetitive throughout the drum chart 150, particularly with respect to the main segments of the performance. Certain segments that define the main parts of the song may be considered to be master segments or loops. Thus, segments that are written to accompany a chorus may be referred to as master chorus segments or loops 170. Segments that are written to accompany a verse may be referred to as master verse segments or loops 172. Other master segments or loops may include bridge loops and possibly pre-chorus loops. In many embodiments, song sets may include approximately three to five different master loops.

In addition, there may be many variations on the master segments or loops. These segments are called matching segments or loops. For example, a loop that is part of a chorus, but includes a special variation may be referred to as a matching chorus loop. Thus, at 174, a drum crash as part of the chorus may be referred to as "Chorus.Crash." A loop that is part of a verse, but includes a special variation, may be called a matching verse loop. Thus, at 176, a rim used instead of a snare in a verse may be called "Verse.Rim." There may be many different matching loops in a song set, depending on the amount of variation provided in the original drum performance.

Figure 3:
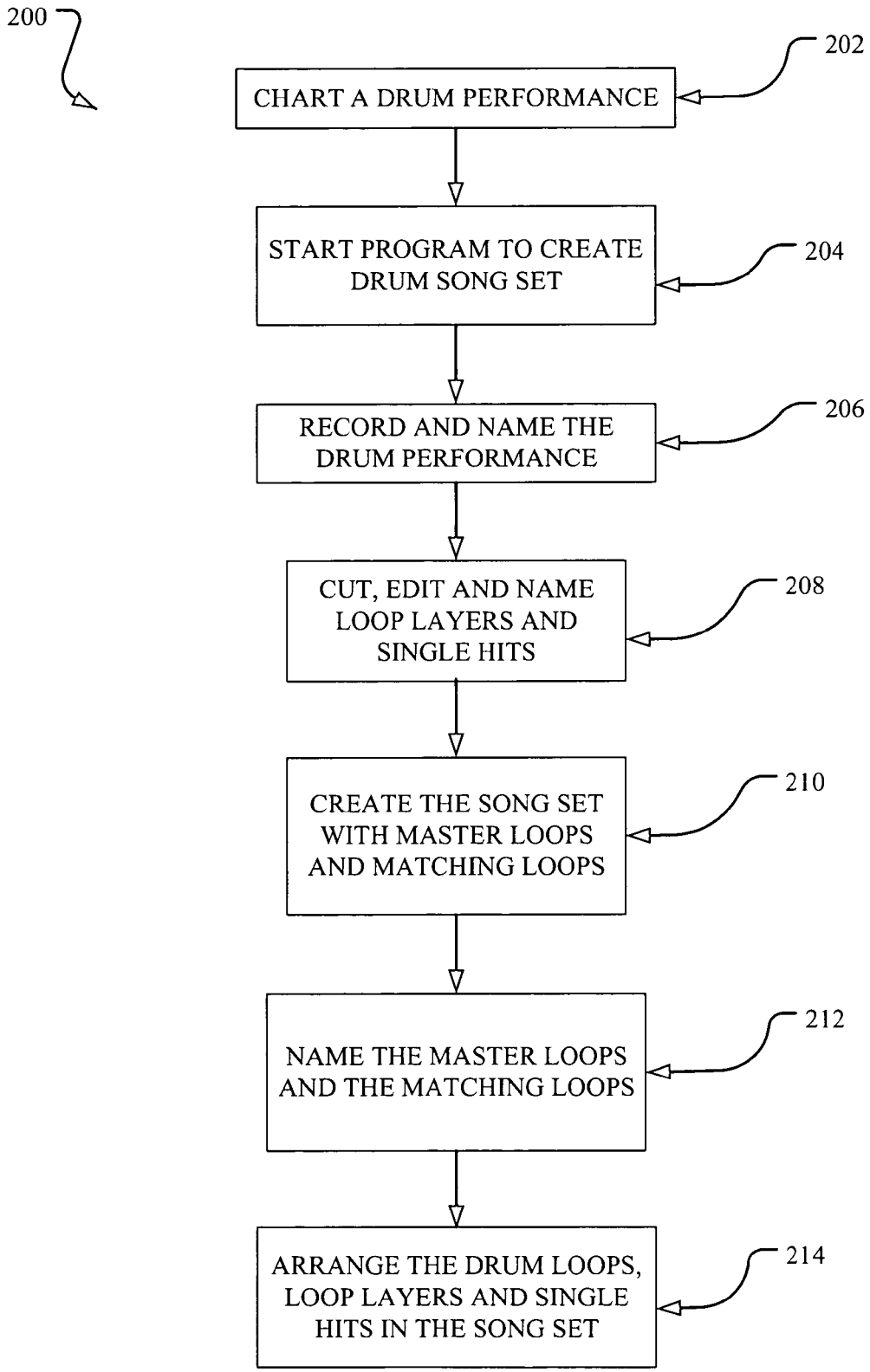
FIG. 3 is a flow diagram showing an example of steps that may be taken to prepare a directory of digital song sets, according to an embodiment of the present invention.

Referring now to FIG. 3, a flow diagram is shown illustrating a exemplary process 200 for preparing a song set from a generic drum performance, such as the one shown in FIG. 2. To begin, at step 202, a drum performance is charted. Then, at step 204, the process of creating a drum song set is begun. This process may include any known audio recording and editing software application or applications. Then, the performance is recorded and named at step 206. The drum performance may be recorded in a multi-track format (e.g., multiple recording sources may be used—generally one per track) and then mixed as a stereo digital recording. The drum performance is preferably given a functionally descriptive name. For example, the drum performance may be named according to its BPM and/or its type of song or genre. An exemplary naming method will be described further below. Loop layers and single hits that relate to the performance may be cut, edited and named at step 208.

Next, at step 210, a song set is created by dividing the recorded drum performance into various segments or loops, as discussed earlier. This operation may be carried out by listening to the recorded drum performance and using conventional audio editing software, such as "Digital Performer" or "Pro Tools," to segment the recorded performance. The recorded performance may be linearly reviewed to identify and segment the master loops and the matching loops. Preferably, the master loops and matching loops comprise non-redundant segments of the recorded drum performance. At step 212, names for the loops may be selected. Preferably, each of the selected names describes a function and other characteristic of the loop, so that the drum loops may be organized and accessed easily by a composer. Typically, master loops may be named "Chorus," "Verse1" or "Verse2," for example. Matching loops in the recorded song set may also be identified and named to characterize their functions. Examples include "Chorus.Rim" or "Verse1. Crash." The names for the loops may be selected from one or more predefined groups of musical descriptors. Finally, at 214, the components of the song set are arranged in an order configured to conveniently assist the composer in identifying useful loops. In one embodiment described below, for example, the contents of a song set may be arranged with the master loops at the top, followed by the matching loops, loop layers and single hits.

FIG. 4 shows an exemplary directory 250 of digital loop drum song sets, arranged in increasing beats per minute (BPM). Each song set is descriptively named with an identifier configured to assist a composer in quickly ascertaining general content of a potential song set. For example, digital song set 252 is described as a "brushes ballad" at 57 BPM. This name immediately identifies the song set as being appropriate for a rather slow song in a ballad style and performed with brushes instead of drumsticks. All of the other song sets have similarly helpful names, such as "Odd Time Shuffle 3_4" at 97 BPM, shown at 254, and "Straight Pop Rock" at 126 BPM, shown at 256. The notation "3_4" indicates ¾ time, as known to those skilled in the art. In many embodiments, the time signature is presumed to be 4/4 time unless otherwise indicated at the end of the song set name.

FIG. 5 shows the contents of an exemplary song set folder 300, possibly taken from the directory 250 of song sets shown in FIG. 4. In the embodiment shown in FIG. 5, the master loops are given a designator in front, such as an exclamation mark ("!") so that, in most end user software programs that sort files alphabetically, there will be a hierarchal structure with the master loops listed at the top, followed by the matching loops. As stated earlier, the master loops generally comprise core loops that establish the main beat patterns of a performance. Usually, master loops comprise a chorus, a verse and a bridge. In many embodiments, however, there may be two or three chorus master loops, two or three verse master loops and a bridge loop. Thus, it is not unusual to have a total of approximately five to six master loops, as shown in the embodiment of FIG. 5.

Folder 300 provides three master chorus loops 302 at the top of the list, namely "Chorus.rim," "Chorus" and "ChorusB." Next are two master verse loops 304, namely "Verse.Rim" and "Verse.B." These five master loops 302 and 304 comprise the core of the song set characterized by folder 300. In some embodiments, an exclamation mark appears in front of each master loop, assuring that the master loops will appear together in hierarchal fashion at the beginning of the respective song set (based on ASCII hierarchy). In the event that a composer is considering using folder 300 because of its beats per minute and its name, he can quickly determine whether the folder will be of further use by exploring the five core master loops at the top of the folder. If they do not provide the desired percussion sounds and rhythms, the composer can quickly move on to another folder without bothering to sample all of the rest of the loops in the folder. Accordingly the hierarchal arrangement of the drum loops described herein has great value in substantially enabling a composer to conveniently sample song sets and select a desired song set.

Following the master loops in the song set folder 300 are a large variety of descriptively named matching loops. The matching loops are also organized to indicate that they are variations of one of the master loops and/or have special functions. This is typically accomplished by adding one or more words after the master loop term to indicate what is different about each matching loop compared to the associated master loop. Thus, a chorus loop that includes a crash is named "Chorus.Crash," and a chorus loop that includes a rim crash is named "Chorus.Rim.Crash," both shown at 306. In many cases, the names are abbreviated to fit within the limited number of characters available under most PC file-naming protocols.

Another matching loop, indicated as "Ending," is shown at 308. Two matching loops, indicated as "Fill1" and "Fill2," shown at 310, do not include a master loop term because they are generic and can be used anywhere in an original composition. Finally, five matching "Verse" loops 312 are listed. It should be noted that, if a matching loop is sufficiently generic, no master loop need be referenced in the matching loop name. Moreover, it is possible for a composer to further edit the provided drum loops, using conventional software, to provide even more variation and realism to the drum composition. The descriptiveness of the drum loop names enables easy identification of loops that a composer might want to further modify.

The naming process is meant to provide as much description as possible to make each loop very readily identifiable and usable. For example, "Chorus.Fill1T" describes a chorus with a fill in it that is more of a "tom-tom" fill. Similarly, "Chorus.Fill2S" describes a chorus with a fill in it that is more of a "snare" fill.

The foregoing exemplary layout of drum loops expedites the use of the loops in the song set to create a new composition. The descriptive names make it easy for a user to preview and apply the desired loops. The other digital loop drum song sets in the directory list shown in FIG. 4 may include a similar, logical and easy-to-use layout and naming convention. However, a composer may use any of the master loops and/or matching loops in any order.

In addition to master and matching loops, a drum song set can include loop layers. As previously stated, loop layers are recorded rhythmic sounds from a single percussion instrument. A drum song set may also include single hits, which each include a single recorded sound from a single percussion instrument. Accordingly, single hits have no rhythm. A composer may select several loop layers and/or single hits and superimpose them on each other in the same measure or measures of a song set, to effectively design a custom loop or phrase. Each loop layer and single hit may be recorded separately, to avoid problems with bleeding over other simultaneous percussion sounds. Preferably, the loop layers and single hits for a song set are recorded at substantially the same time as the drum performance is recorded, to ensure that the same feel is included and that the drum tuning is the same as the rest of the performance. The loop layers and single hits may be stored in separate folders within a song set.

Thus, in contrast to master and matching loops that are derived from a recorded drum song, the loop layers and single hits may include recorded sounds from a single instrument that are separately recorded. By using loop layers and single hits, a composer may greatly expand the variations already provided by matching loop layers, resulting in great flexibility and variety in a finished composition.

FIG. 6 shows a sample list 350 of loop layers 352 and single hits 354 in a song set. As with the master and matching loops, the loop layers may be descriptively named to enable logical organization and quick access to desired drum sounds. The loop layers are rhythmic beats by the same instrument over one or two measures. For example, at 356, the names "LL.H1," "LLH2" and "LLH3" refer to three different high-hat patterns. At 358, the names "LL.R1," "LL.R2" and "LL.R3" refer to three different ride patterns. Next, "LL.Rim" represents one rim pattern. In addition, the single hits, shown at 354, include single instrument hits or beats without any rhythm. Accordingly, at 360, "H1" and "H2" are single high-hat hits that may be worked into the combinations with the loop layers or with other loops, as desired.

The exemplary song sets shown in FIGS. 4 through 6 may be implemented, and organized as described above, on any computer or processor-readable medium or other digital storage device. For example, song sets may be created as described above. Data representative of the song sets may then be stored to any computer or processor-readable medium or media suitable for storing the song sets. As used herein, a computer and processor-readable medium may include, but is not limited to, volatile memory, non-volatile memory, optical media, CD-ROMs, DVDs, magnetic media, Flash memory, hard disks, ROM, RAM, floppy discs, databases, central memory storage devices associated with servers, removable memory devices, memory devices configured to store downloadable data, and any other storage medium that may accessibly store digital audio data. In many embodiments, one or more song sets is written onto a CD-ROM for distribution to a customer. In other embodiments, one or more song sets may be downloaded from a server-side computing device to a client-side computing device.

The song sets, as well as the drum loops contained in the song sets are preferably named in accordance with descriptive ASCII terminology that will present the song sets to a user (e.g., a composer) in an intuitive, hierarchical order so that the user is able to quickly and conveniently sort through the song sets to identify desired drum loops. The organization and descriptive names of song sets and drum loops shown in FIGS. 4 through 6 may be presented to the user within one or more user interfaces, such as a graphical user interface ("GUI").

Figure 7:
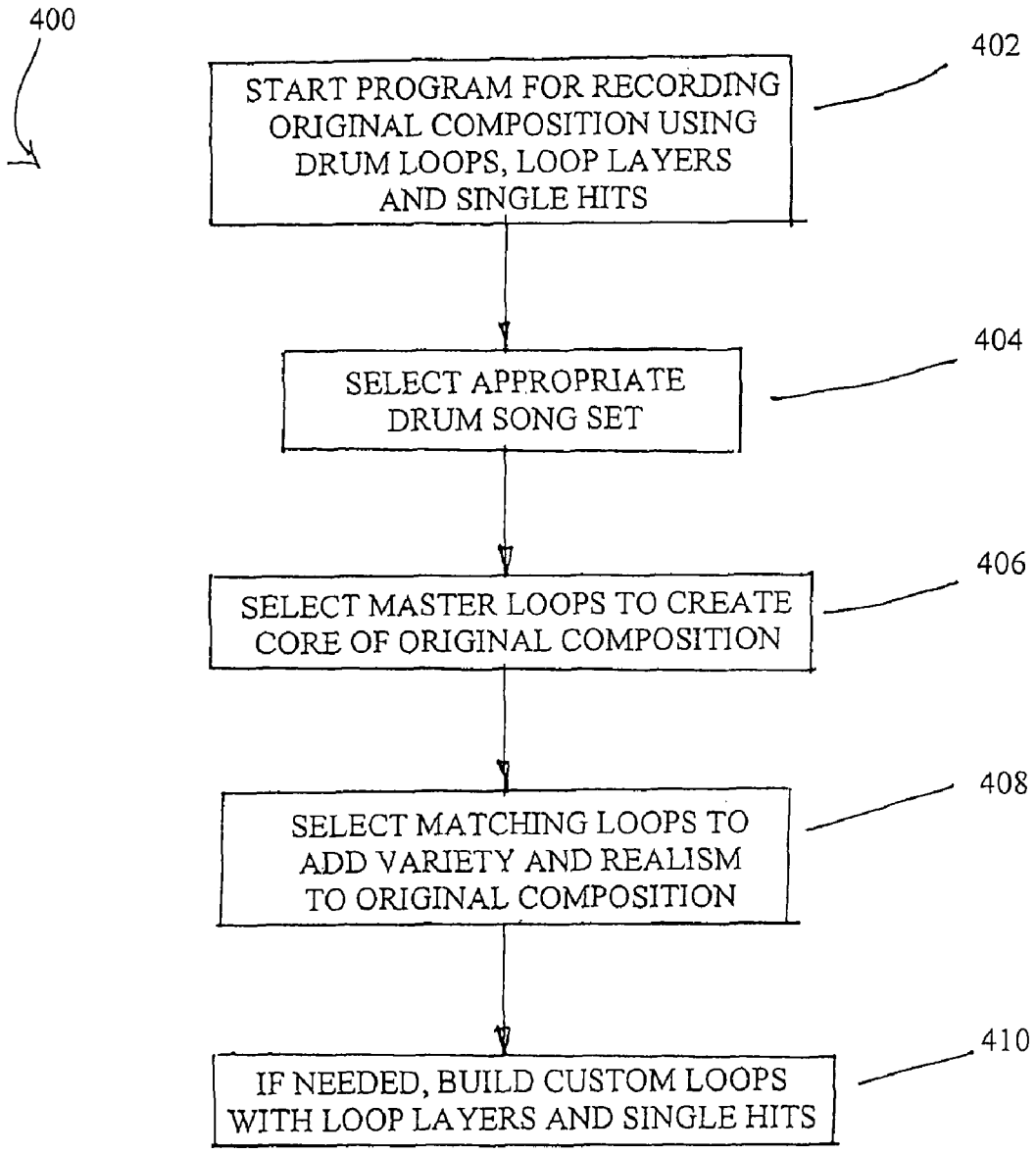
FIG. 7 is a flow diagram showing an example of steps that may be taken in composing and/or recording a musical composition using a selected song set according to the embodiment of FIGS. 4-6.

Referring now to FIG. 7, a flow diagram 400, beginning at step 402, is provided to show an exemplary process for creating percussion instrumentation for an original and unique musical composition and/or recording, using drum loops, loop layers and single hits. A composer first selects a drum song set, at step 404, by reference to the beats per minute and the title of various song sets. Because of the organized arrangement and description of the song sets, it is easy for the composer to quickly listen to several song sets and determine which is appropriate for a particular composition concept.

Next, at step 406, the composer selects the master loops that fit the composition concept and lyrics. The master loops provide the core of the original composition to enable the composer to quickly assemble the main flow of the composition. Then, at step 408, various matching loops are selected to fill in the composition and to give variety to the unique composition. The natural progressions built into the original drum song set carry over to make it easy to select matching loops that fit well with the master loops. If one of the master loops does not seem to fit one part of the composition, the composer is able to use loop layers and single hits, at step 410, to build one or more custom drum loops.

It is also possible for a composer to first pick a song set that has the genre and style he wants. Then, using the master loops, the composer writes a composition to fit that style and beat. Thus, the master loops in a song set may be used to inspire the creation of a musical composition.

Figure 8:
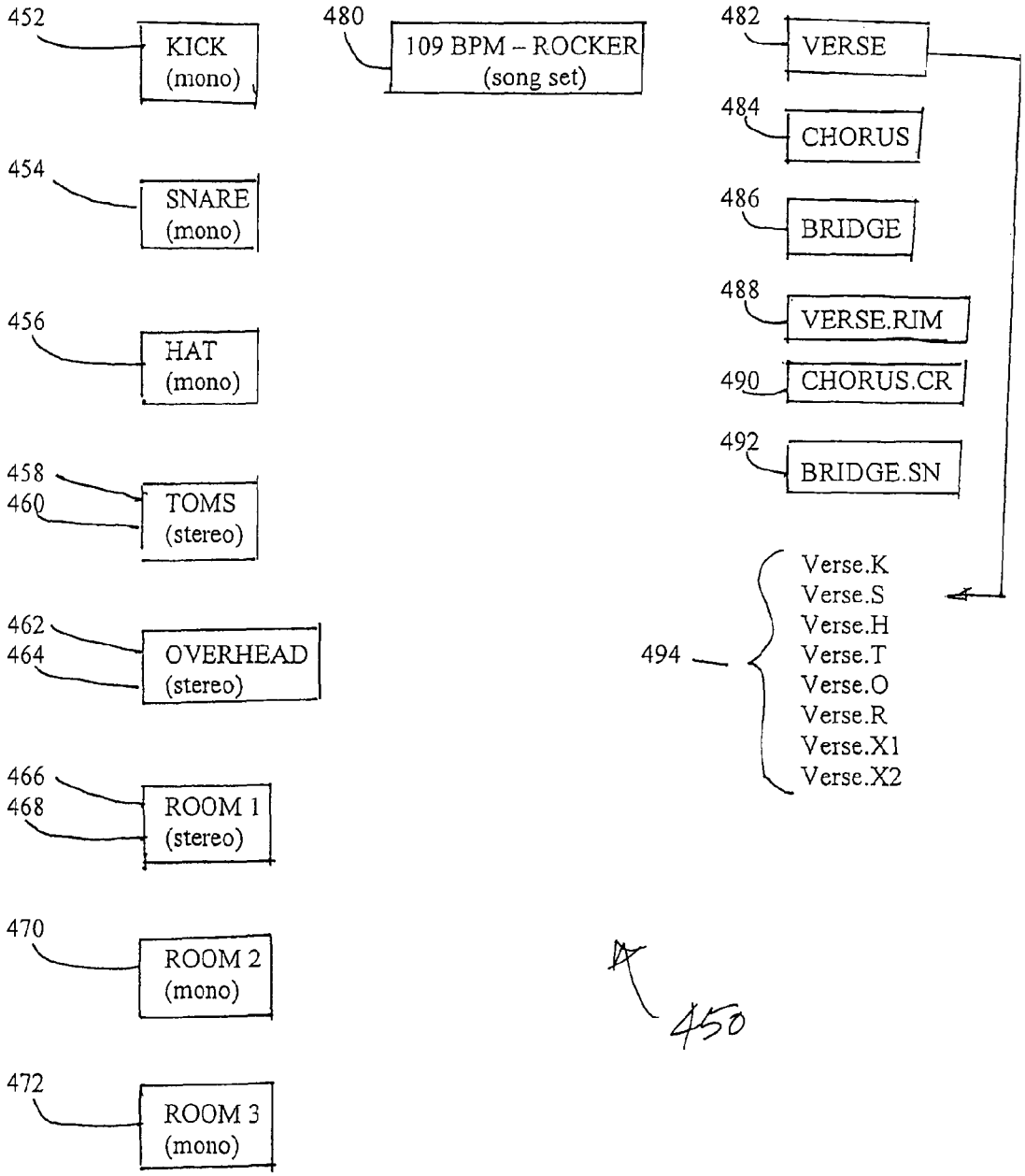
FIG. 8 is an exemplary multiple-track set of drum loops used in connection with another embodiment of the present invention.

Looking now at FIG. 8, a further aspect is disclosed in the form of multi-track loops. The loops shown and discussed with respect to FIGS. 3-5 are typically recorded in a premixed stereo format. In an original recording process, typically ten to twelve tracks are recorded, each track being positioned at a different location relative to the instruments. Thus, one track microphone may be set up by the snare, another microphone may be located by the hats, another by the left tom-toms, another by the right tom-toms, and so forth. Then during the mixing process a good balanced stereo mix is made by professional personnel using known tools and techniques.

Although the foregoing mixing process may be satisfactory in most cases, a composer may want to emphasize one percussion instrument more than is done in the stereo mix presented as part of the master and matching loops. For special effects and emphasis, the composer may use a multi-track recording version. Certain portions of the recording may be revised to emphasize one or more percussion instruments, to add or enhance reverberation or to vary a large number of different parameters. Furthermore, other adjustments may be desired, such as changing the equalization, reverberation, compression, and so forth.

FIG. 8 shows an arrangement 450 for creating percussion instrumentation for an original composition using multiple-track loops. For the arrangement shown in FIG. 8, master and matching loops are cut from a multiple-track signal, rather than from a single mixed stereo signal. The result is to provide access to each of the tracks, so that a composer has greater flexibility and freedom to compose exactly the percussion sounds desired. In the embodiment shown in FIG. 8, eleven tracks are provided, corresponding to the placement of microphones during recording of a generic performance. The microphones (also referred to as "mikes") may be placed in the following positions:

Mike 452—kick drum (mono)
Mike 454—snare drum (mono)
Mike 456—hat drum (mono)
Mikes 458, 460—tom drums (stereo)
Mikes 462, 464—overheads (stereo)
Mikes 466, 468—room (stereo)
Mike 470—room extreme short (mono)
Mike 472—room extreme long (mono)

Other embodiments may use different numbers and/or arrangement of microphones.

A drum chart is performed and each of the eleven tracks is recorded. A folder 480 is created for the song set, with a BPM and a name assigned to the folder 480. The tracks are segmented at the same time in one to two measure segments, and are numbered according to each microphone. For a given song set, each drum loop segment (e.g., a master loop or matching loop) in the song set contains eleven drum loops, one for each track.

Alternately, for the multiple track version, each drum loop segment may be a separate folder containing each of the tracks therein. Thus, master loop folders may be created, including a verse folder 482, a chorus folder 484 and a bridge folder 486. Matching loop folders may also be created, including a "Verse.Rim" folder 488, a "Chorus.Crash" folder 490 and a "Bridge.Snare" folder 492. Each of the master loop folders and matching loop folders have eleven drum loops therein. For example, the master loop verse folder 482 may contain eleven master verse loops 494, as follows: "Verse.K," "Verse.S," "Verse.H," "Verse.T," "Verse.O," "Verse.R," "Verse.X1" and "Verse.X2," corresponding to the master loops for the kicks, snares, hat, toms, overhead, room, extreme 1 and extreme 2 microphones. All of the other drum loop folders can also have eleven drum loops therein, corresponding to the microphone placement described above.

The tracks may be organized into a common folder, such as a song set folder or a drum loop folder. In such embodiments, the tracks may be named according to a convention that provides uniformity to the order in which the types of tracks are presented to a composer. In particular, ASCII conventions may be utilized to assign characters to specific track types. For example, "01" may be included in filenames for kick drum tracks, "02" may be included in filenames for snare drum tracks, "03" may be included in filenames for hat tracks, "04" may be included in filenames for toms tracks, "05" may be included in filenames for overheads tracks, "06" may be included in filenames for rooms tracks, "07" may be included in filenames for extreme kit tracks, and "08" may be included in filenames for extreme room tracks. Of course, other ASCII characters may be used in track filenames to specify a particular ordering convention for the tracks.

Figure 9:
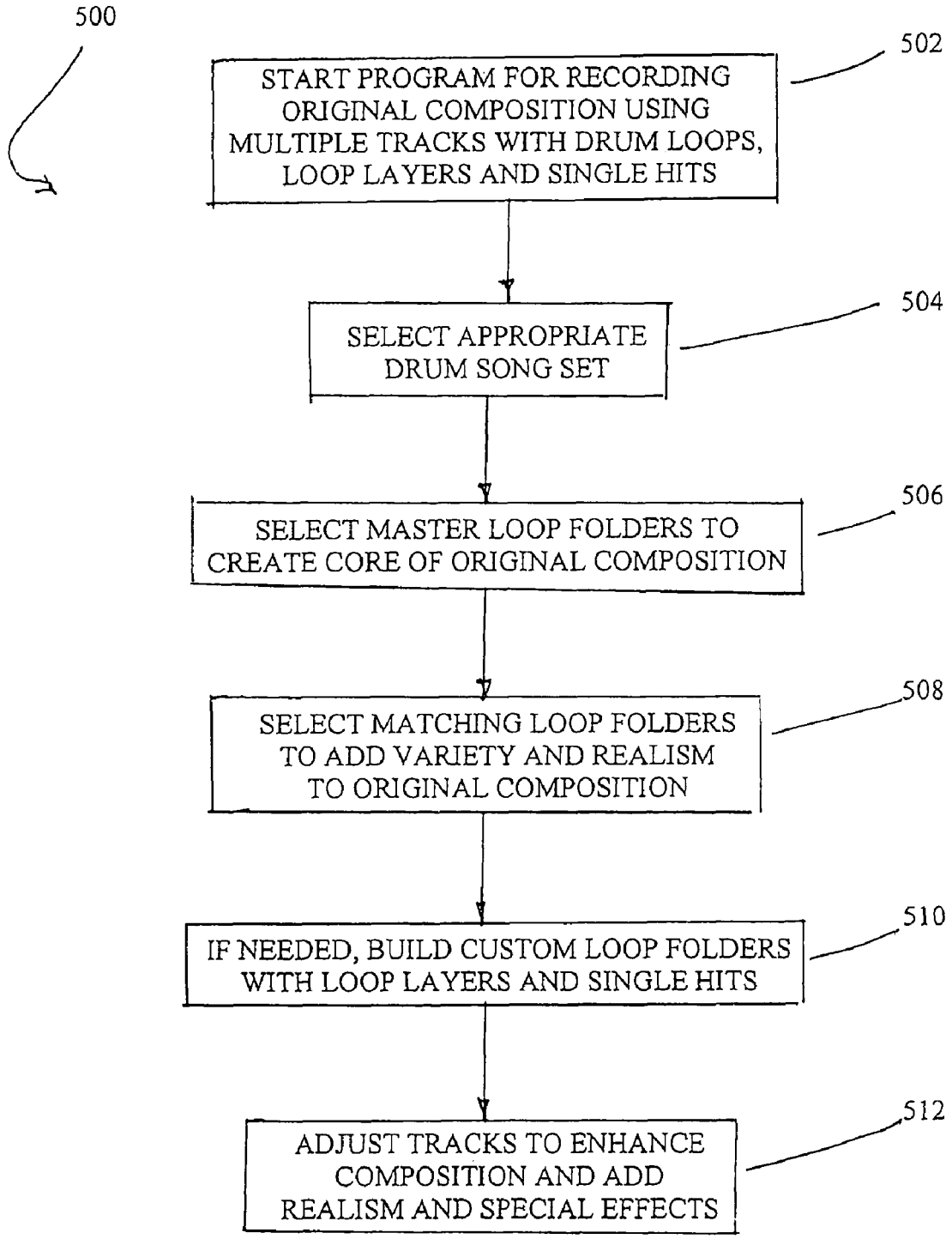
FIG. 9 is a flow diagram showing an example of steps that may be taken in composing and/or recording a musical composition using a selected song set and multiple tracks, according to the embodiment of FIG. 8.

Referring now to FIG. 9, an exemplary flow diagram 500 is shown for creating a multiple-track version of drum loops. A program (e.g., software program) for the multiple-track process is started at step 502. As in FIG. 7, the multiple-track process uses drum loops, loop layers and single hits. However, in the multiple-track version, each drum loop is a folder having eleven track loops therein. Thus, the composer has the advantage of adjusting each track of each drum loop to achieve maximum effect and control in the mix.

At step 504, a composer selects a digital drum song set by reference to the beats per minute and the title of various song sets. Because of the organized arrangement and description of the song sets, it is easy for the composer to quickly listen to several song sets and determine which is appropriate for his composition concept. Next, at step 506, the composer selects the master loop folders that fit with his composition concept and style. The master loop folders provide the core of the original composition to enable the composer to quickly assemble the main flow of the composition. In the multiple-track version, there may also be a stereo version outside the multiple track folder, to facilitate easy previewing of the song set. In fact, one may use the stereo version to first create the original performance. Then a composer may go to the multiple track folders that have the same folder names, and pick the multiple track loops by placing them onto the original composition in the same location as the stereo loops. When the original composition is complete, the stereo tracks may be muted or deleted.

Then, at step 508, various matching loop folders may be selected to fill in the composition and give variety to the unique composition. The natural progressions built into the original drum song set recording carry over to make it easy to select matching loop folders that fit well with the master loop folders. If one of the master loop folders does not seem to fit one part of the composition, the composer is able to use loop layers and single hits, at step 510, to build one or more custom loops. Finally, the composer may adjust selected tracks in each of the drum loop folders in order to achieve whatever effects are desired.

The multiple-track arrangement makes it possible for a composer to have substantially more freedom in creating an original musical composition. Each track may be individually modulated to control the volume of the corresponding microphone, which in turn increases or decreases the amount of input received from the corresponding percussion instrument. In addition, special effects, such as reverberation and compression, may be applied to only one of the tracks, rather than to all of them. The result is a highly stylized original musical composition.

The foregoing processes enable creation of original recordings of percussion instrumentation that are customized to fit a composer's concept and musical composition. The large variety of master loops, matching loops, loop layers and single hits gives a composer great flexibility is designing a unique and original composition. Because of the organization and naming of the digital song sets, a search for an appropriate song set is expedited and the original composition may be assembled quickly with a great amount of variety. The unity and integrity of the originally recorded drum performances carries through the song sets to provide an authentic, realistic and professional percussion sound in the final product—an original composition and/or recording.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A computer program product for of recording and organizing recorded drum sequences for use in composing music, the computer program product comprising a non-transitory computer-readable medium having instructions thereon, the instructions comprising:

code programmed to:

(a) record an entire drum performance using a plurality of microphones onto a processor readable medium, (b) access the entire recorded drum performance with a processor and separate the recorded drum performance into a plurality of drum loops stored in said processor readable medium, (c) organize the drum loops into a song set in said processor readable medium, and (d) provide a unique name for each drum loop, the unique name being descriptive of a possible position or function of each drum loop in the song set, said unique name being stored in said processor readable medium wherein each of said drum loops being independently accessible by said processor for the construction of a musical composition.

2. The computer program product of claim 1, wherein the plurality of drum loops comprise a plurality of types and are organized in hierarchal fashion, according to type of drum loop.

3. The computer program product of claim 1, wherein said processor-readable medium further includes instructions which, when accessed by said processor;

repeat the recording, separating, organizing, and providing steps to form a plurality of song sets, and providing a plurality of song set names, each of the plurality of song set names identifying one of the plurality of song sets, each of the plurality of song set names including a beats per minute (BPM) identifier and a description of a style or genre associated with the contents of the corresponding one of the plurality of song sets.

4. The computer program product of claim 3, wherein the song set names are configured for presentation in a non-decreasing order of beats per minute.

5. The computer program product of claim 1, wherein the separating step includes separating each drum loop into a sequence about one to two measures in length.

6. The computer program product of claim 1, wherein the separating step comprises providing a set of master loops that reflect the main feel and style of the recorded drum performance.

7. The computer program product of claim 6, wherein said processor-readable medium further includes instructions which, when accessed by said processor:

assign a master loop name to each master loop in the set of master loops, wherein the master loop name is selected from a group comprising two or more of the following music descriptors: a chorus descriptor, a pre-chorus descriptor, a verse descriptor, and a bridge descriptor.

8. The computer program product of claim 6, wherein the separating step comprises providing a set of matching loops that are configured to provide variation to the set of master loops.

9. The computer program product of claim 8, wherein said processor-readable medium further includes instructions which, when accessed by said processor: assign a matching loop name to each matching loop in the set of matching loops, wherein the matching loop name includes the corresponding master loop name and an identifier that is descriptive of a possible function of the matching loop.

10. The computer program product of claim 8, wherein the set of master loops are disposed at the beginning of the song set and the set of matching loops are placed after the master loops in a hierarchal fashion in the song set.

11. The computer program product of claim 1, wherein said processor-readable medium further includes instructions which, when accessed by said processor record a plurality of drum loop layers, each being a recording of sounds made by a single drum type.

12. The computer program product of claim 11, wherein each drum loop layer in the plurality of drum loop layers is about one to two measures in length.

13. The computer program product of claim 11, wherein said processor-readable medium further includes instructions which, when accessed by said processor: assign a drum loop layer name to each loop layer in the plurality of drum loop layers, the drum loop layer name including a descriptor of the type or function of the single drum.

14. The computer program product of claim 11, wherein each loop layer is configured to be superimposed over at least one other loop layer or over at least one of the plurality of drum loops to create a custom drum loop, pattern, or fill.

15. The computer program product of claim 1, wherein said processor-readable medium further includes instructions which, when accessed by said processor record a plurality of single hits, each being a recording of a single sound made by a single drum type.

16. The computer program product of claim 15, wherein said processor-readable medium further includes instructions which, when accessed by said processor: assign a single hit name to each single hit in the plurality of single hits, the single hit name including a descriptor of the type or function of the single drum.

17. The computer program product of claim 15, wherein each single hit is configured to be superimposed over at least one loop layer, at least one other single hit in the plurality of single hits, or at least one of the plurality of drum loops to create a custom drum loop, pattern, or fill.

18. The computer program product of claim 1, wherein each drum loop comprises a plurality of tracks, each track of the plurality of tracks being associated with either a specific microphone used to capture the recorded drum performance or a particular type of percussion instrument, wherein said computer program product is configured to receive inputs from 11 discrete microphones assigned to independent placements.

19. The computer program product of claim 18, wherein said processor-readable medium further includes instructions which, when accessed by said processor: assign a track name to each of said plurality of tracks, said track name including a descriptor of a type of percussion instrument that is predominant in the corresponding one of said plurality of tracks.

20. The computer program product of claim 19, wherein said processor-readable medium further includes instructions which, when accessed by said processor: organizes the plurality of tracks by drum type.

21. A method of recording and organizing recorded drum sequences for use in composing music, comprising:

positioning 11 discrete microphones assigned to independent placements near percussion instruments;

recording a plurality of drum performances via said 11 discreet microphones onto a processor-readable medium, accessing said drum performances on said processor-readable medium with a processor;

separating each recorded drum performance, via said processor, into 11 drum loops of different types, ordering the plurality of drum loops in each song set in hierarchal fashion according to type of drum loops, and ordering the song sets according to tempo and genre.

22. A method of creating a song set for use in creating and recording a composition, comprising:

(a) recording a plurality of master loops from an entire drum performance, the plurality of master loops being representative of the core of the song set;

(b) recording a plurality of matching loops configured to provide variations to the plurality of master loops;

(c) positioning the plurality of master loops first in the song set; and (d) positioning the plurality of matching loops after the master loops in the song set.

23. The method of claim 22, further comprising naming each of the plurality of master loops with a name descriptive of a function or position of the master loop in the song set.

24. The method of claim 23, further comprising naming each of the plurality of matching loops with a matching loop mane descriptive of a function or position of the matching loop in the song set.

25. The method of claim 24, wherein the matching loop name includes at least a portion of the name of a corresponding one of the plurality of master loops to indicate that the matching loop is a variation of the corresponding master loop.

26. The method of claim 22, further comprising recording at least one loop layer for the song set and positioning the at least one loop layer after the plurality of matching loops in the song set.

27. The method of claim 22, further comprising recording at least one single hit for the song set and positioning the at least one single hit after the plurality of matching loops in the song set.

28. A system for generating a musical composition, comprising:

a processor;

a processor-readable medium including:

at least one song set for use in creating and recording a musical composition, said at least one song set including a plurality of master loops representative of the core of the song set, the plurality of master loops being positioned first in the song set;

a plurality of matching loops being recorded from an entire drum performance and then parsed into the matching loops, the plurality of matching loops being configured to provide variations to the plurality of master loops, the plurality of matching loops being positioned after the plurality of master loops in the song set; and a graphical user interface (GUI);

wherein said processor-readable medium, when accessed by said processor, causes said GUI to display accessible graphical representations of said plurality of names identifying said plurality of drum loops to enable direct access to said plurality of drum loops.

29. The system of claim 28, wherein the at least one song set further comprises a plurality of master loop names, each of the plurality of master loop names including a descriptor of a function or position of the corresponding master loop in the song set.

30. The system of claim 28, wherein the at least one song set further comprises a plurality of matching loop names, each of the plurality of matching loop names including a descriptor of a function or position of the corresponding matching loop in the song set.

31. The system of claim 30, wherein each of the matching loop names includes at least a portion of a master loop name of one of the plurality of master loops to indicate that the matching loop identified by the matching loop name is a variation of the master loop identifying by the master loop name.

32. The system of claim 28, wherein the at least one song set further comprises at least one loop layer positioned after the plurality of matching loops in the song set, the at least one loop layer including a rhythmic recording of sounds produced by a single drum type.

33. The system of claim 28, wherein the at least one song set further comprises at least one single hit positioned after the plurality of matching loops in the song set, the at least one single hit including a recording of a single beat by a single drum type.

* * * * *